US006835079B2

(12) United States Patent
Gentry et al.

(10) Patent No.: US 6,835,079 B2
(45) Date of Patent: Dec. 28, 2004

(54) ELECTRICAL CONNECTOR ASSEMBLY WITH SHORTING MEMBER

(75) Inventors: John T. Gentry, Springfield, MO (US); Roger C. Williams, Nixa, MO (US); Tim O. Kepley, Marshfield, MO (US)

(73) Assignee: Positronic Industries, Inc., Springfield, MO (US)

( * ) Notice: Subject to any disclaimer, the term of this patent is extended or adjusted under 35 U.S.C. 154(b) by 0 days.

(21) Appl. No.: 10/154,487

(22) Filed: May 23, 2002

(65) Prior Publication Data

US 2003/0220006 A1 Nov. 27, 2003

(51) Int. Cl.[7] ..... H01R 29/00
(52) U.S. Cl. ..... 439/188; 439/510
(58) Field of Search ..... 439/188, 507, 439/509, 510–514

(56) References Cited

U.S. PATENT DOCUMENTS

| | | | | |
|---|---|---|---|---|
| 4,123,629 A | | 10/1978 | Chagnon et al. | |
| 4,152,041 A | * | 5/1979 | Hollyday et al. | 439/188 |
| 4,894,019 A | | 1/1990 | Howard | |
| 4,906,203 A | | 3/1990 | Margrave et al. | |
| 5,201,853 A | * | 4/1993 | Alwine | 439/188 |
| 5,509,819 A | * | 4/1996 | Stein et al. | 439/510 |
| 5,529,507 A | | 6/1996 | Felix et al. | |
| 5,672,073 A | | 9/1997 | Matsumura et al. | |
| 5,897,389 A | | 4/1999 | Dietz et al. | |
| 5,944,545 A | * | 8/1999 | Willhelm et al. | 439/188 |
| 6,241,542 B1 | * | 6/2001 | Nishide et al. | 439/188 |
| 6,422,897 B1 | * | 7/2002 | Odorfer | 439/510 |

FOREIGN PATENT DOCUMENTS

| | | |
|---|---|---|
| DE | 29 03 896 A1 | 8/1979 |
| DE | 197 02 373 A1 | 8/1998 |
| DE | 197 47 115 A1 | 4/1999 |
| DE | 199 15 562 C1 | 1/2001 |
| EP | 0 389 7779 A2 | 10/1990 |
| EP | 0 432 368 A1 | 6/1991 |

OTHER PUBLICATIONS

Partial European Search Report for European Patent Application EP 03 25 3254, Aug. 5, 2003, 4 pages, European Patent Office, Munich.

* cited by examiner

*Primary Examiner*—P. Austin Bradley
*Assistant Examiner*—Felix O. Figueroa
(74) *Attorney, Agent, or Firm*—Senniger Powers

(57) ABSTRACT

An electrical connector assembly has a shorting member which is capable of electrically connecting or "shorting" certain contacts within a first connector when disconnected from a second connector to avoid an open circuit condition. The shorting member may be configured to short three or more contacts at the same time, and to be disengaged automatically upon connection of the first and second connectors. Moreover, the shorting member may be formed of a single piece of material and have an opposed pair of arms for engaging each contact.

34 Claims, 15 Drawing Sheets

ELECTRICAL CONNECTOR ASSEMBLY WITH SHORTING MEMBER

BACKGROUND OF THE INVENTION

This invention relates generally to the field of electrical connectors and more particularly to an electrical connector having a shorting member.

In some applications, it is necessary to short a circuit when electrical connectors establishing the primary circuit are disconnected. One such application is a current monitoring circuit which uses current transformers to detect and monitor current in a load line. Typical current transformers include wire wrapped in a coil around a donut-shaped core. The current transformer is installed so that a load line runs through the middle opening of the core. A primary current in the load line induces a secondary current of proportional value in the wire of the current transformer. In typical current monitoring circuits, the secondary current runs through secondary lead lines from the current transformer to a terminal block. A current monitoring device such as an ammeter is connected to the corresponding terminals on the terminal block to accept the secondary current from the secondary lead lines of the current transformer. When the primary current passes through the load line, the secondary current is simultaneously induced in the current transformer and carried by the secondary lead lines to the terminal block. The secondary current then passes from the terminal block to the current monitoring device.

The current monitoring device will from time to time need to be disconnected from the current monitoring circuit. If the current monitoring device is disconnected from the terminal block while primary current is present in the load line, the current transformer will be "open circuited". When open circuited, the current transformer begins to store energy. Reconnection of the current monitoring device to the current transformer can result in a very large instantaneous current which burns up the current transformer.

In existing current transformer circuits, before disconnecting the current monitoring device from the current transformer, shorting wires or jumpers are required to be installed to prevent open circuiting of the current transformer and the resulting damage. The installation of a jumper across the secondary lead terminals is a cumbersome and time-consuming process requiring the services of a trained technician or professional electrician. Before the current monitoring device is disconnected, the jumper must be installed in the terminal block to electrically connect the two secondary leads and prevent open circuiting of the current transformer. By shorting the two secondary leads before disconnecting the current monitor device, the storage of electrical energy in the current transformer is prevented.

Existing electrical connectors that perform a shorting function upon disengagement of the contacts are inadequate for many types of circuits. For example, it is frequently advantageous for a single electrical connector to house the contacts for multiple electrical circuits. This arrangement requires a single shorting device housed in the connector that is capable of shorting multiple contacts. To accommodate high voltage circuits, electrical connectors require large "clearance distances" or large "creepage distances" between the shorting member and the contacts. Clearance distance is the straight line distance between electrical conductors when an open space is between the conductors. Creepage distance is the path measured between electrical conductors when there is a non-conductive surface between the conductors.

Because of the inadequate clearance or creepage distance between shorting members and the contacts of the connector, existing electrical connectors are limited to use on low voltage applications.

SUMMARY OF INVENTION

Among the several objects and features of the present invention may be noted the provision of an electrical connector capable of shorting a circuit when disconnected from a mating connector; the provision of such an electrical connector which can short three or more different contacts of the connector; the provision of such an electrical connector which can short either male or female contacts; the provision of such an electrical connector which can short non-adjacent contacts; the provision of such an electrical connector which can fully disengage the shorting member; the provision of such an electrical connector useful in circuits carrying larger voltages; the provision of such an electrical connector which can use either fixed or removable contacts; the provision of such an electrical connector which can provide simple variations of function that are easily incorporated into manufacture.

Generally, the electrical connector of the present invention comprises a first insulating body with at least three first contacts housed in the first insulating body. A second insulating body houses at least three second contacts. The first and second contacts are adapted for interengagement to produce an electrical connection. A shorting member is mounted on the first insulating body and is disposed for electrically connecting the first contacts. When the first and second contacts are not interengaged, the shorting member connects the first contacts in an engaged position for simultaneously electrically shorting the first contacts.

In another aspect of the present invention, the electrical connector of the present invention generally comprises an insulating shroud that surrounds each of the second contacts. Each insulating shroud is sized and shaped to engage the shorting member as the first and second insulating bodies are moved to interengage the first and second contacts. The insulating shroud moves the shorting member to a disengaged position in which the shorting member is disengaged from at least some of the first contacts.

In another aspect of the present invention, an electrical shorting member for connecting multiple contacts of an electrical connector assembly is provided. The electrical shorting member comprises a web having a first pair of arms and second pair of arms. The first pair of arms is connected to the web and arranged for simultaneously engaging one of the multiple contacts. The second pair of arms is connected to the web at a location spaced apart from the first pair of arms. The second pair of arms is arranged for simultaneously engaging another one of the multiple contacts so that the first and second arms are adapted to engage respective multiple contacts to provide a shorting connection by way of the web between the contacts of the electrical connector assembly.

In yet another aspect of the present invention, an electrical connector assembly generally comprises a first insulating body formed for receiving at least three first contacts therein, and a second insulating body formed for receiving at least three second contacts therein. The second insulating body is adapted for connection with the first insulating body. A shorting member is mounted on said first body and disposed for engaging said first contacts upon insertion of said first contacts into the first insulating body for electrically connecting said at least three first contacts.

In still another aspect of the present invention, an electrical connector generally comprises an insulating body formed for receiving at least three first contacts therein and for connection to another insulating body of a different connector. A shorting member is mounted on said insulating body and disposed for engaging said at least three first contacts upon insertion of said first contacts into the insulating body for electrically connecting said first contacts.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
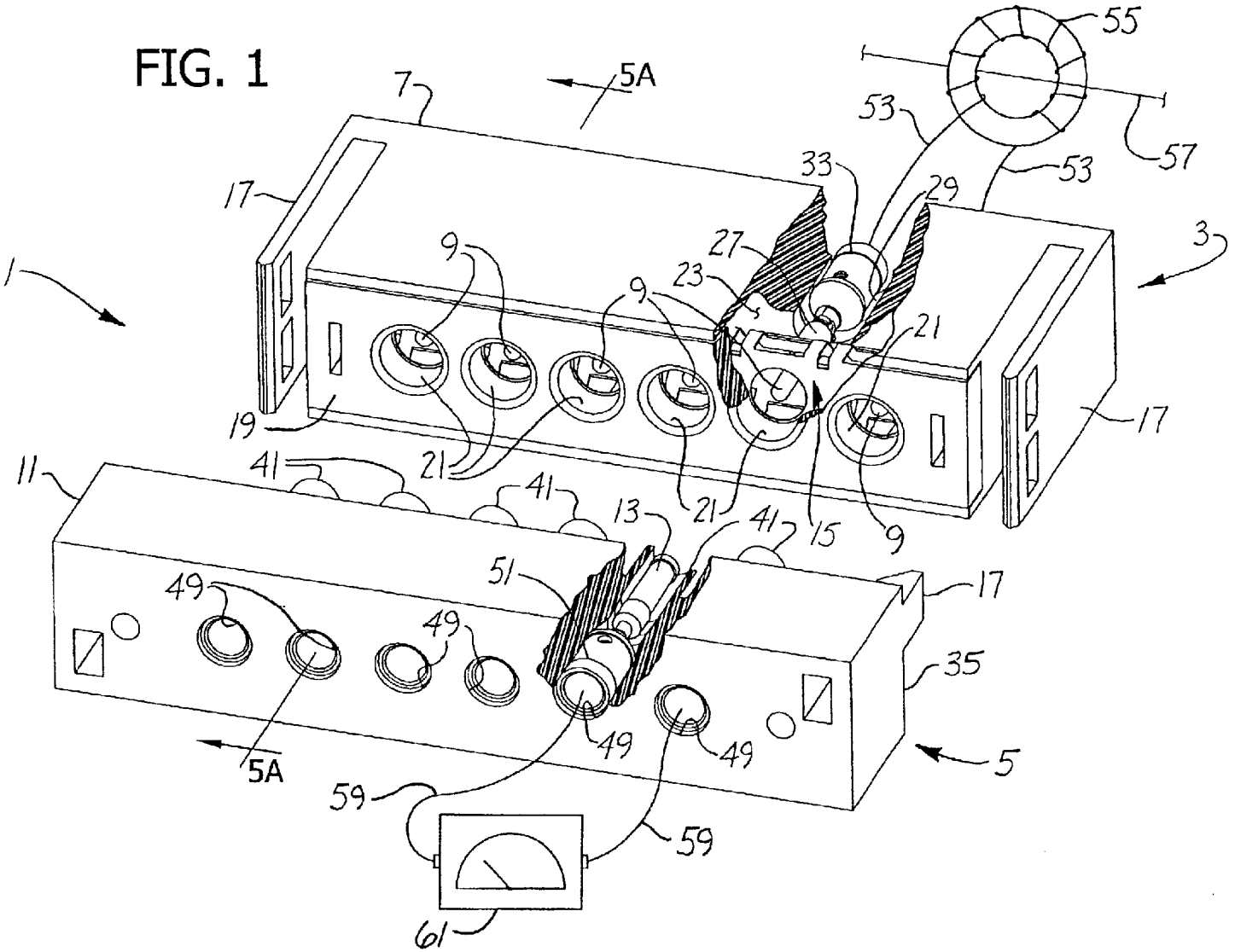
FIG. 1 is a perspective of an electrical connector assembly of the present invention with parts of first and second connectors of the assembly broken away to show internal construction.

Referring now to the drawings, and in particular to FIG. 1, an electrical connector assembly 1 includes a first connector 3 and a second connector 5 (the reference numerals designating their subjects generally). The first connector 3 includes a first insulating body 7 which houses six first contacts 9. The second connector 5 includes a second insulating body 11 which houses six second contacts 13. First contacts 9 and second contacts 13 are adapted for interengagement to produce an electrical connection when first connector 3 and second connector 5 are mated. A shorting member generally indicated at 15 and mounted inside first insulating body 7 electrically connects all of the first contacts 9 when first connector 3 and second connector 5 are in an unmated condition (FIG. 1). First connector 3 and second connector 5 each include a pair of discriminating latching members 17 of the kind described in U.S. Pat. No. 4,900,261, the disclosure of which is incorporated herein by reference.

Figure 2:
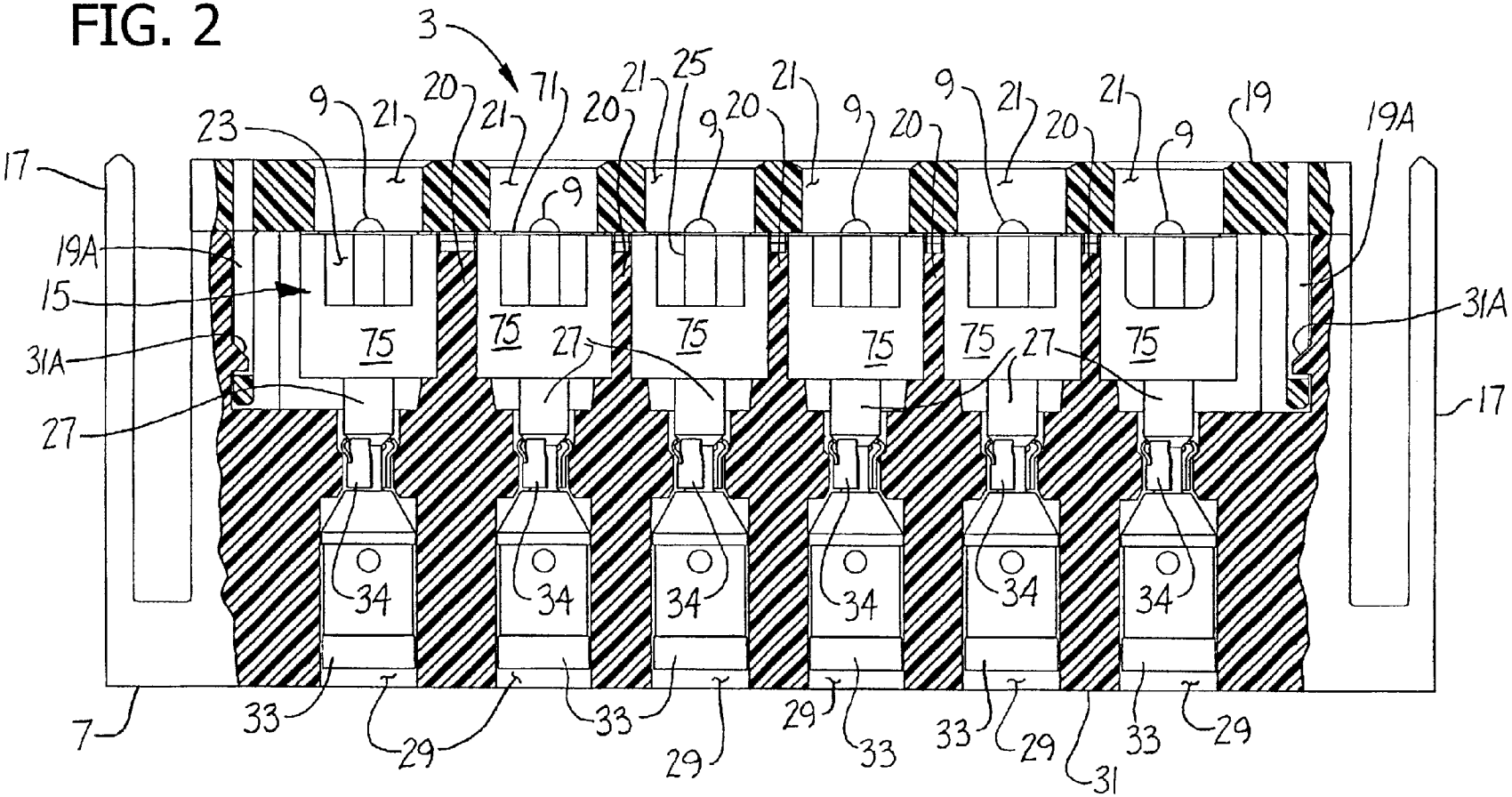
FIG. 2 is a side elevation of the first electrical connector of the assembly with an insulating body thereof partially broken away to show male contacts and a shorting member.
Figure 3:
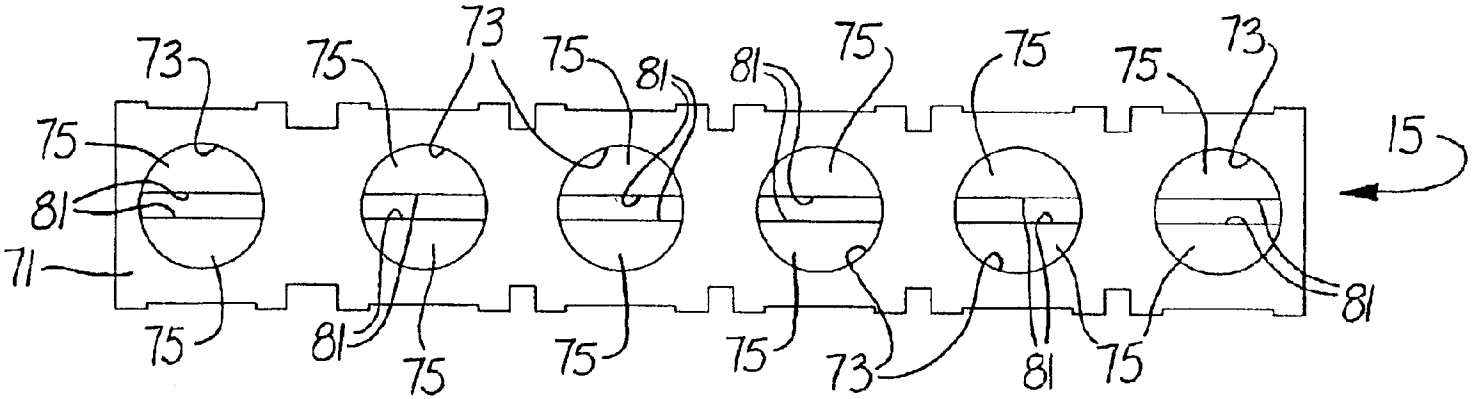
FIG. 3 is a front elevation of the shorting member.
Figure 4:
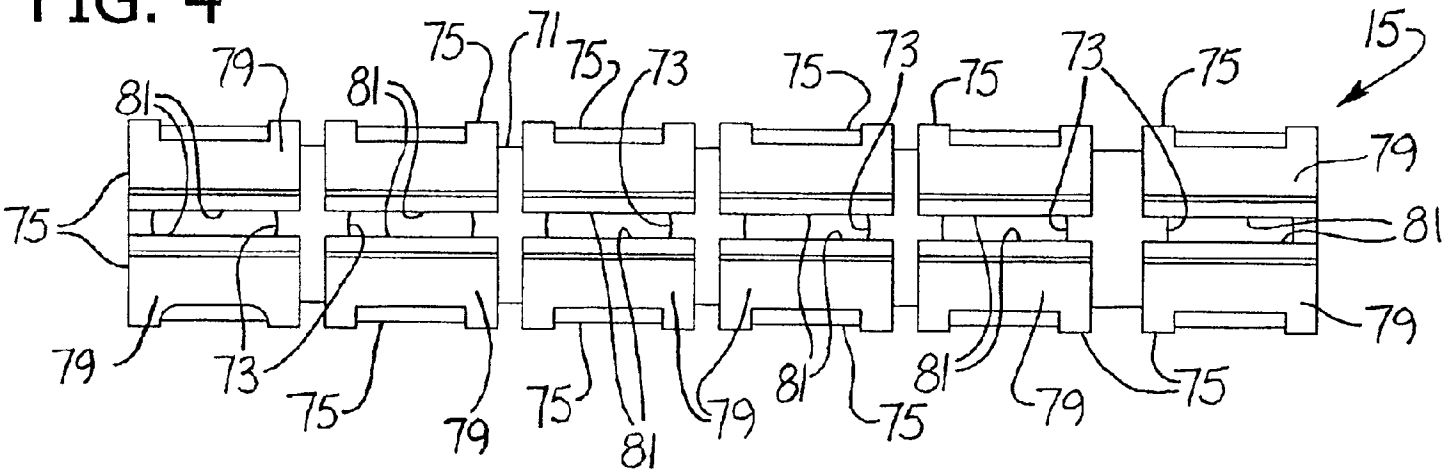
FIG. 4 is a rear elevation of the shorting member.

In the embodiment of FIGS. 1 and 2, the first contacts 9 housed in first insulating body 7 are male contacts and the second contacts 13 housed in second insulating body 11 are female contacts shaped to receive corresponding male contact. Shorting member 15 is illustrated in the first connector 3 in association with male contacts 9. As will be further described, other embodiments of the invention include having a shorting member associated in a connector with female contacts. Therefore, it should be understood that the first contacts as used in the claims could be female contacts and the second contacts could be male contacts without departing from the scope of the present invention. Moreover, the number of contacts is at least three in one aspect of the invention, but may be fewer than three in other aspects. Furthermore, first contacts 9 and second contacts 13 may be contacts of any type commonly used in electrical connectors (i.e., crimp, solder or press fit). In the illustrated embodiment, both first and second contacts 9, 13 are commonly supplied separate from the first and second insulating body 7, 11 with the contacts being installed into their respective insulating body in the field. In that event, the first insulating body 7 and shorting member 15 are still assembled prior to shipment. It is to be understood that one or both sets of contacts 9, 13 could be installed at the factory without departing from the scope of the present invention.

In FIGS. 1 and 2, the first insulating body 7 has a front wall 19 having front cylindrical passageways 21 leading to an inner cavity 23 where the male contacts 9 and shorting member 15 are located. Adjacent inner cavities 23 are separated by posts 20 (broadly "holding members") that support shorting member 15. Male contact 9 has a mating portion 25 of solid cylindrical construction and a rounded free end and a larger diameter portion 27. The mating portion 25 is axially aligned with front cylindrical passageway 21 and partially protrudes into the passageway. The inner cavity 23 leads to a back cylindrical passageway 29 which extends out through a rear body portion 31 of the first insulating body 7. In the illustrated embodiment, the front wall 19 is formed separately from the rear portion 31, allowing easy access to the cavity 23 for placement of the shorting member 15 in the cavity. The front wall 19 is snap-connected to the rear portion 31. To that end, the front wall has a pair of integrally formed U-shaped latch hooks 19A which snap over corresponding latch tabs 31A formed with the rear portion and projecting into the cavity 23 (see FIG. 2). When the front wall 19 is pushed down onto the rear portion 31, the U-shaped latches 19A are resiliently deflected by the latching tabs 31A, but then snap back behind the tabs to secure the front wall on the rear portion. However, the front wall 19 may be connected in other ways, or formed as one piece with the rear portion 31 without departing from the scope of the present invention. A termination end 33 of the male contact 9 having hollow cylindrical construction extends from the inner cavity 23 into back cylindrical passageway 29. A retainer 34 is attached to the male contact 9 between larger diameter portion 27 and termination end 33 to secure the male contact in insulating body 7. It will be understood that the shorting member 15 and retainer 34 are commonly fabricated from a suitable resilient material having favorable wear and strength characteristics such as heat treated beryllium copper.

Figure 5A:
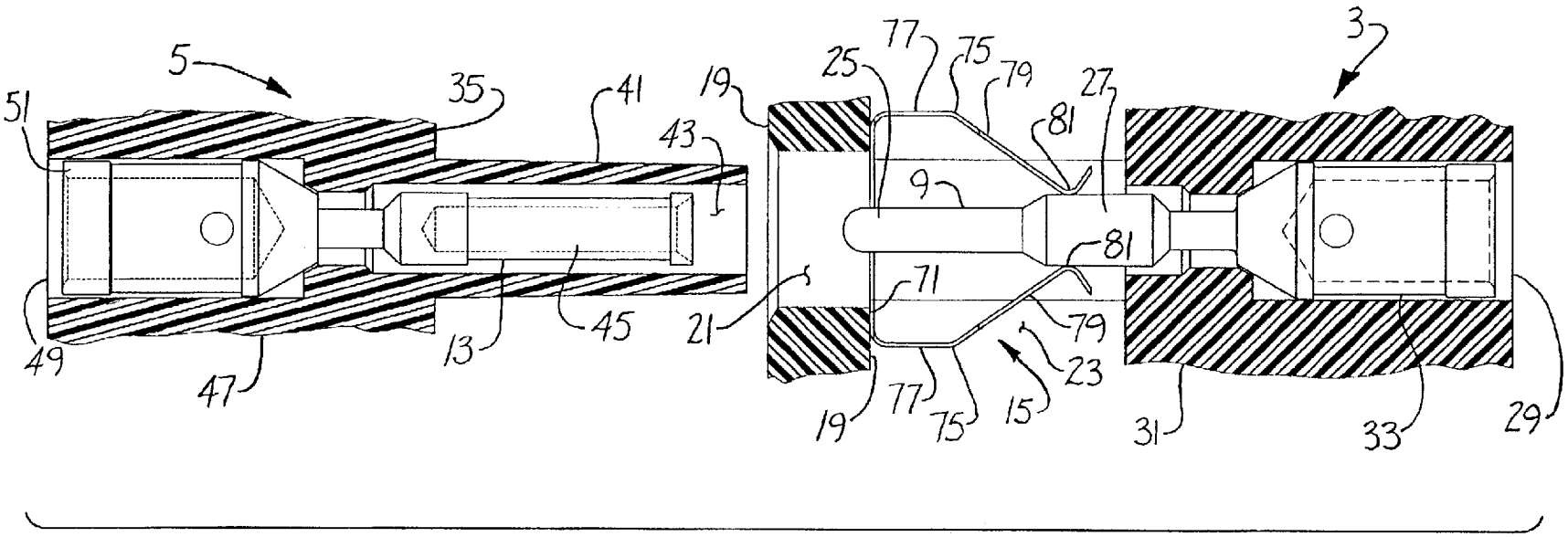
FIG. 5A is a fragmentary section of the electrical connector assembly taken in the plane including line 5A—5A of FIG. 1.

Second insulating body 11 has a series of integral insulating shrouds 41, each generally tubular in shape and protruding from second insulating body front wall 35 (See FIGS. 1 and 5A). Insulating shrouds 41 each define a portion of a front cylindrical passageway 43 that houses a tubular mating portion 45 of one of the female contacts 13. The mating portion 25 of male contact 9 is generally shaped to fit inside the corresponding mating portion 45 of female contact 13 so that the male contact and female contacts make electrical connection. The insulating shroud 41 extends beyond the free end of the female contact 13. The second insulating body 11 has a main body portion 47 having a series of back cylindrical passageways 49 that house a termination end 51 of female contacts 13.

Termination ends 33 and 51 of respective male and female contacts 9 and 13 can be connected to wires leading to an electrical device in a conventional manner (i.e., crimp or solder). It will be understood that male and female contacts 9, 13 could include termination ends of solid cylindrical construction (not shown) protruding from the back of insulating body 7, 11 such that the termination ends may be press fit or soldered into respective openings in a circuit board. For example, FIG. 1 shows a schematic diagram illustrating a typical current monitoring circuit. Termination ends 33 of two adjacent male contacts 9 are connected to lead lines 53 of an annular current transformer 55 through which passes a load line 57. Termination ends 51 of two adjacent female contacts 13 are connected to lead lines 59 of an ammeter 61 so that when first connector 3 and second connector 5 are engaged, the ammeter displays the current in the load line 57. When the connectors are disconnected as shown in FIG. 1, the current transformer 55 would store electrical energy in an open circuited condition because a current continues to flow through the load line 57. The shorting member 15 keeps the current transformer circuit closed by electrically connecting the contacts 9. Thus, current is allowed to flow through the current transformer 55 so that no electrical energy builds up. It will be understood that shorting member 15 could be connected to an external ground wire (not shown) or alternatively the termination end 33 of one of the male contacts 9 could be connected to an external grounding wire, thereby providing a grounding path for all contacts electrically connected by shorting member 15.

Referring now to FIGS. 1–5C, the shorting member 15 extends substantially the length of the inner cavity 23 of the first insulating body 7. The shorting member 15 has a generally planar web 71 held against the inner surface of front wall 19 by posts 20. The web 71 has a series of openings 73 that are larger than and axially aligned with the front cylindrical passageways 21 of the first insulating body 7. Pairs of opposed arms 75 extend from web 71 at locations which are spaced longitudinally of the web. As illustrated in FIGS. 1–5C, there is one pair of opposed arms 75 for each male contact 9. The posts 20 are constructed to be wider than the space between adjacent pairs of opposed arms 75 so the opposing arms of each pair are in contact with and held open somewhat by one side of a corresponding post. Preferably the separation established by the posts 20 is greater than the diameter of the leading portion of the contact 9 so that when the contact is inserted into the insulating body 7 through the passageway 29, it is readily received between opposing arms 75. Each shorting arm 75 has a first orthogonal portion 77 extending from web 71 and a second converging portion 79 extending from the first orthogonal portion and converging toward the opposite arm. An outwardly flaring engagement portion 81 extends from the end of the converging portion 79 to touch the larger diameter portion 27 of the male contact 9. The shorting member 15 is preferably made of a resilient material allowing the arms 75 of each pair to flexibly bend relative to the web 71. However, it is envisioned that the arms could be biased by a spring or other device (not shown) separate from the shorting member 15.

In the relaxed condition of the shorting member 15 (see FIG. 4), the engagement portions 81 are spaced a distance which is less than the diameter of the larger diameter portion 27 of the male contact 9. Thus as disposed in the insulating body 7 of the first connector 3, the engagement portions 81 touch opposite sides of the larger diameter portion 27 and are biased against the male contact 9 by the resiliency of the shorting member 15 because they are held away from their relaxed position by the male contact (FIG. 5A). The bias facilitates maintenance of electrical contact of the shorting member 15 with the male contact 9. As shown in FIG. 2, all of the male contacts 9 of the first connector 3 are electrically connected by the shorting member 15, and so all circuits terminated at the first connector are shorted out when the first connector is disconnected from the second connector 5. In the illustrated example of FIG. 1, the current transformer lead lines 53 connected to adjacent male contacts 9 are electrically connected via the shorting member 15 when the first connector 3 and second connector 5 are disconnected.

Figure 5B:
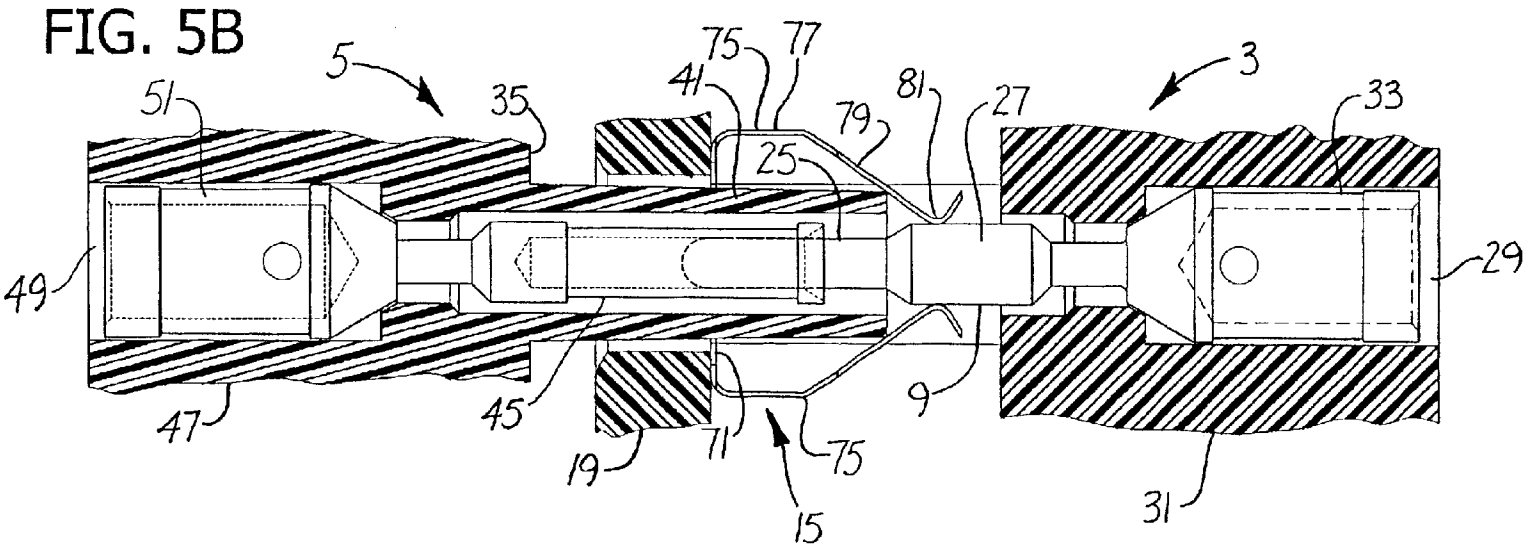
FIG. 5B is the fragmentary section of FIG. 5A but illustrating an intermediate position prior to full mating connection of the first and second contacts.
Figure 5C:
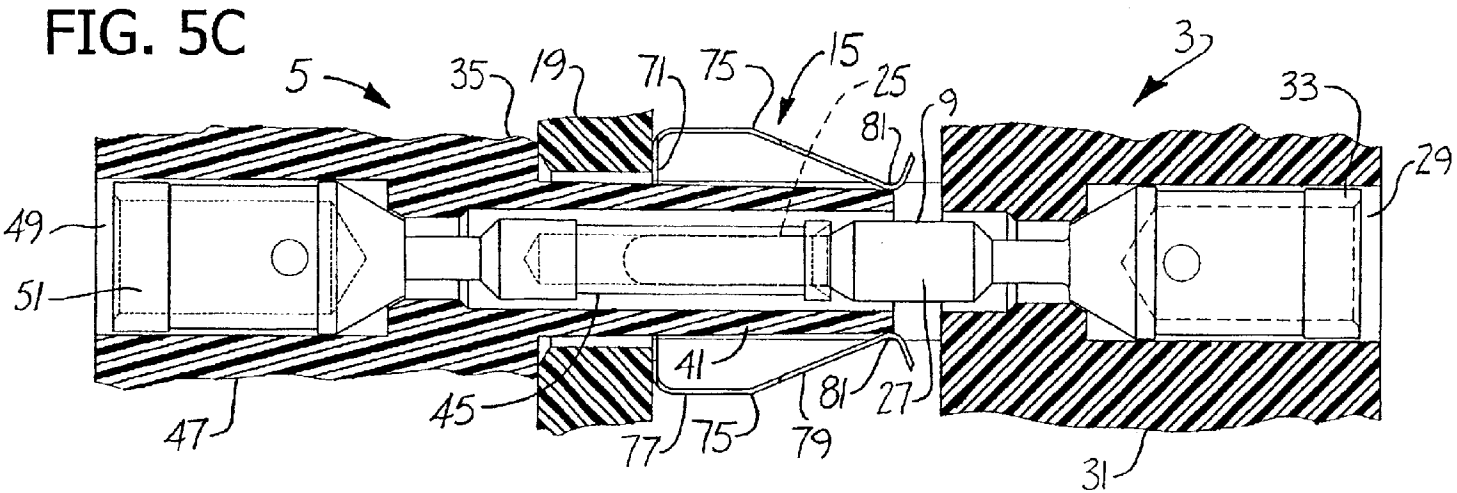
FIG. 5C is the fragmentary section FIG. 5A but illustrating a fully mated connection of the first and second connectors.

The interengagement of first connector 3 and second connector 5 is illustrated in FIGS. 5A thru 5C. FIG. 5A shows the first connector 3 and second connector 5 in a fully disconnected condition similar to FIG. 1, just prior to entry of the shrouds 41 of the second connector into the passageways 21 of the first connectors. The remaining description of the connection of the first and second connectors, 3 and 5 respectively, will be made for one male contact 9 and one female contact 13, the connection of the other contacts of the connectors being identical. As the first connector 3 and second connector 5 are brought further together, the mating portion 25 of the male contact 9 enters the mating portion 45 of the female contact 13 making electrical connection between the male and female contacts (FIG. 5B). The electrical connection occurs while the contacts 9 of the first connector 3 are all still shorted by the shorting member 15 so that arcing is avoided. At about the intermediate position illustrated in FIG. 5B, the shroud 41 engages the opposed arms 75.

As the first and second connectors are brought together from the intermediate position of FIG. 5B to a fully connected position, the insulating shroud 41 engages the converging portions 79 of the opposed arms 75 and pushes the arms apart. The arms 75 resiliently bend relative to the web 71 to position further from the relaxed positions of the arms. When the first and second connectors are fully connected, the insulating shroud 41 is interposed between the engagement portion 81 of each shorting arm 75 and large diameter portion 27. Also, in the fully engaged position of FIG. 5C, the front wall 35 of second insulating body 11 is in contact with the front wall 19 of first insulating body 7. In the fully engaged position of first and second connectors 3, 5, the insulating shroud 41 provides an insulating barrier between shorting arms 75 and the mated male and female contacts, 9 and 13 respectively. The presence of an insulating barrier results in higher creepage and clearance distances in the connector. The creepage distance is preferably at least 1.6 mm and the clearance distance is preferably at least 1.0 mm. As a result of the higher creepage and clearance distances, the electrical connector of the present invention can operate under relatively high voltages of up to about 150 Volts.

Figure 6:
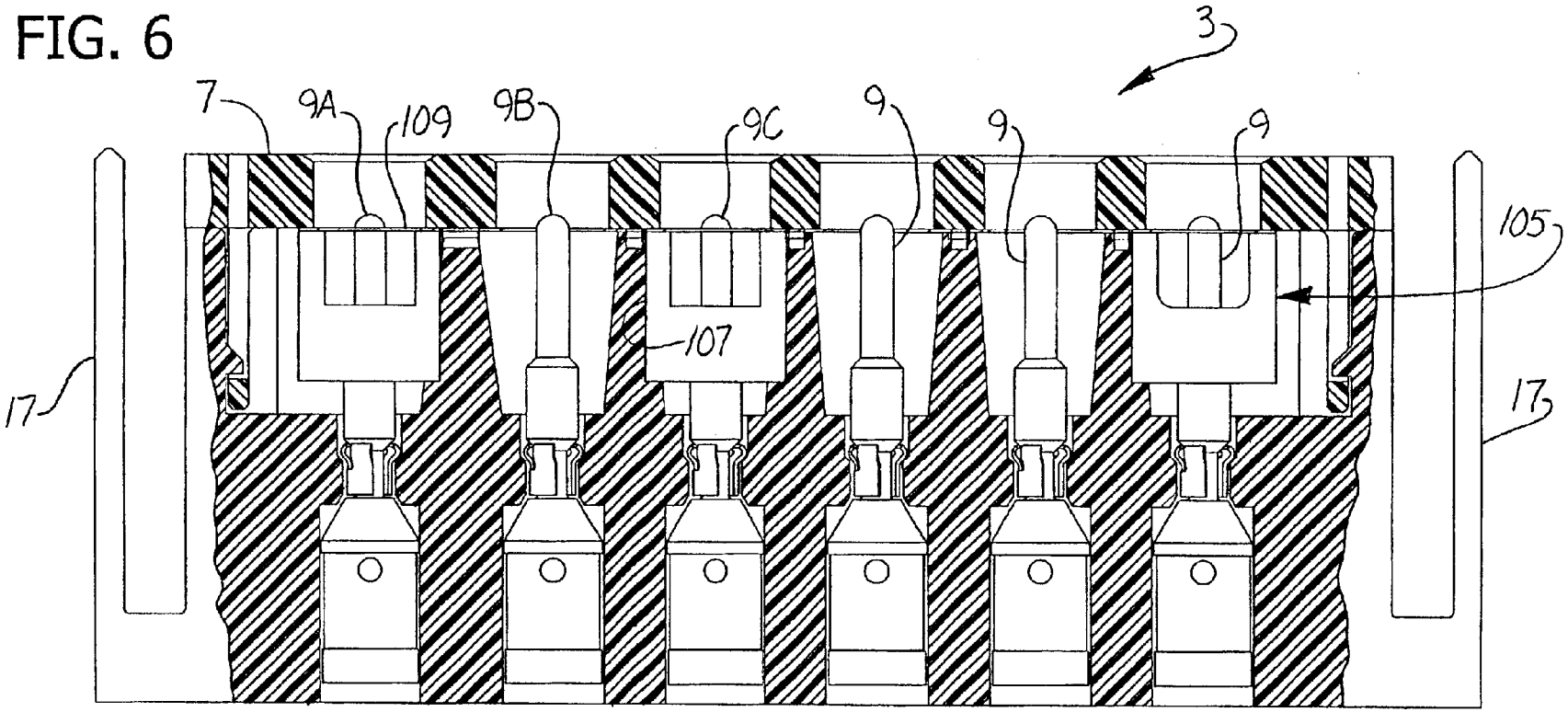
FIG. 6 is a side elevation of a first connector with an insulating body thereof partially broken away to show a first modified shorting member.

Referring now to FIG. 6, the first connector 3 is shown housing a first modified shorting member generally indicated at 105. The shorting member 105 of this embodiment is similar to the shorting member 15 illustrated in FIG. 2 but having pairs of opposed arms 107 for only some of the male contacts 9 housed in the first insulating body 7. The arms 107 of the shorting member 105 are similarly connected to each other by a common web 109 which allows non-adjacent male contacts 9A and 9C (for example) to be electrically shorted. Other male contacts, contact 9B (for example), will not be shorted when the first and second connectors 3, 5 are disconnected. It will be understood a shorting member 105 may be configured to short combinations of male contacts 9 other than those illustrated in FIG. 6 without departing from the scope of the present invention. The shorting member 15 shown in FIGS. 3 and 4 can be readily customized to a particular configuration by removing opposed pairs of arms 75. The disconnection of the arms 107 of the shorting member 105 from the male contacts 9 upon connection of the first and second connectors 3, 5 is the same as described above with respect to FIGS. 5A–5C.

Figure 7:
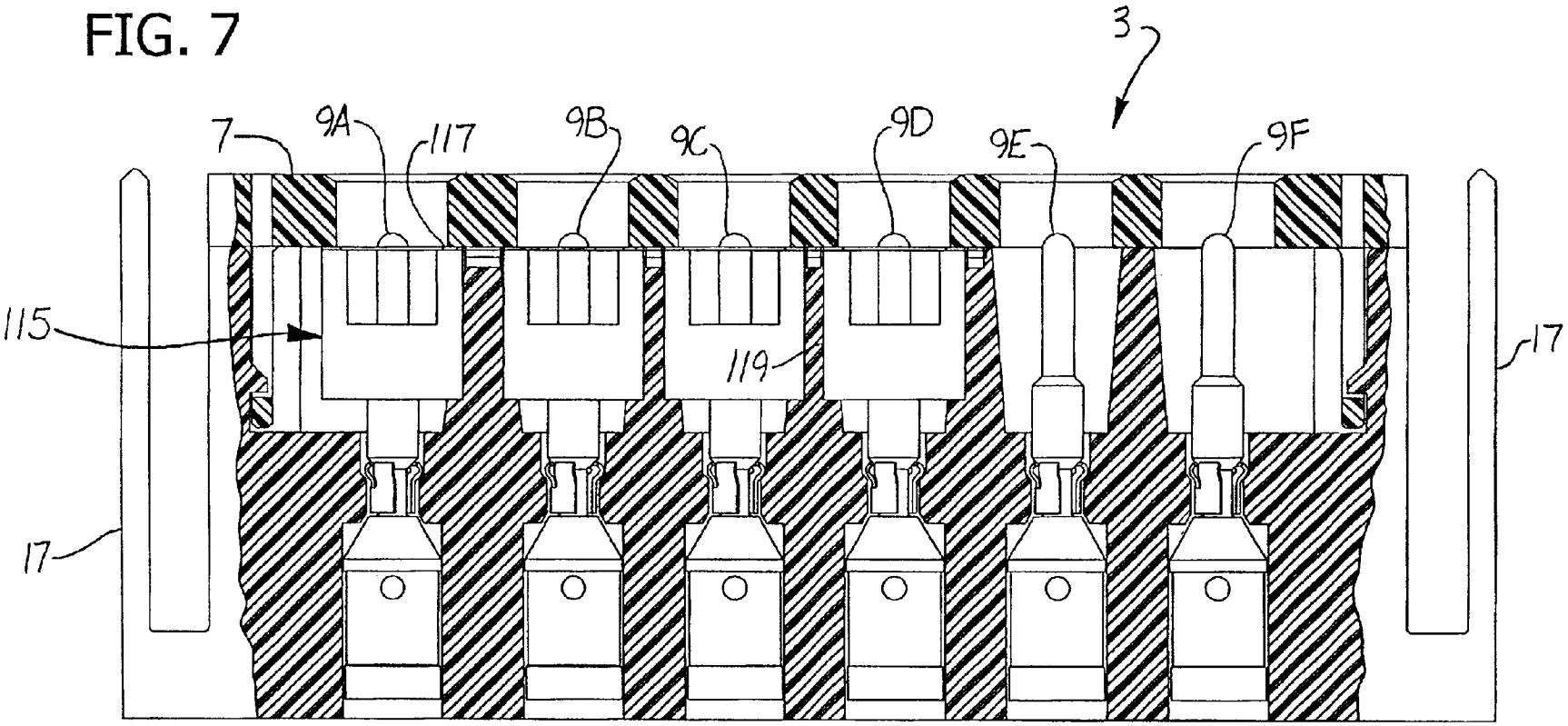
FIG. 7 is a side elevation of a first connector with an insulating body thereof partially broken away to show a second modified shorting member.

The first connector 3 shown in FIG. 7 houses a second modified shorting member 115 that achieves a similar purpose as the shorting member 105 of FIG. 6, but with a different construction. The shorting member 115 includes a modified web 117 that spans only a partial width of the connector 3. In the illustrated embodiment, the web 117 encompasses only the first four male contacts 9A thru 9D so that the two adjacent contacts 9E and 9F do not have pairs of opposed shorting arms 119. It will be understood that by modifying the shorting member 115 in the manner of this embodiment, any number of adjacent end contacts or contacts on opposite ends can be constructed without a shorting connection.

Figure 8:
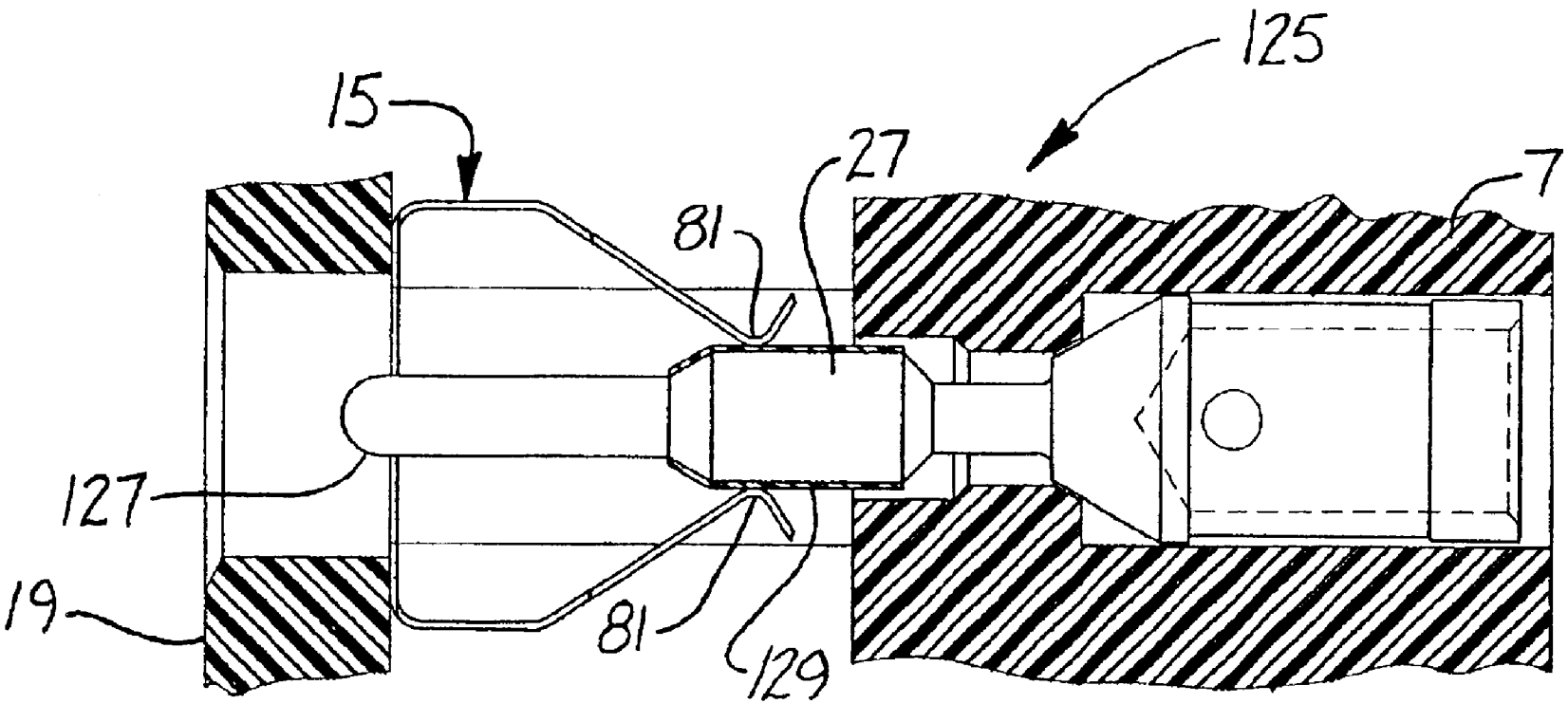
FIG. 8 is a fragmentary section of a first connector modified to include an insulator over a portion of a male contact.

Yet another configuration for preventing the shorting member from making electrical connection with certain male contacts is shown in FIG. 8. A modified first connector 125 houses the shorting member 15 shown in FIGS. 3 and 4. However, the male contact 127 housed in the first insulating body 7 has an insulating cover 129 completely surrounding larger diameter portion 27. Insulating cover 129 prevents electrical connection between male contact 127 and shorting member 15 upon disengagement of the first and second connectors 125, 3. Preferably, the insulating cover 129 would be applied to the metal contact 127 prior to insertion into the insulating body 7 of the modified first connector 125. By selectively choosing which contacts 127 have the insulating cover 129, electrical connectors having different combinations of shorting connections can be made.

Figure 9:
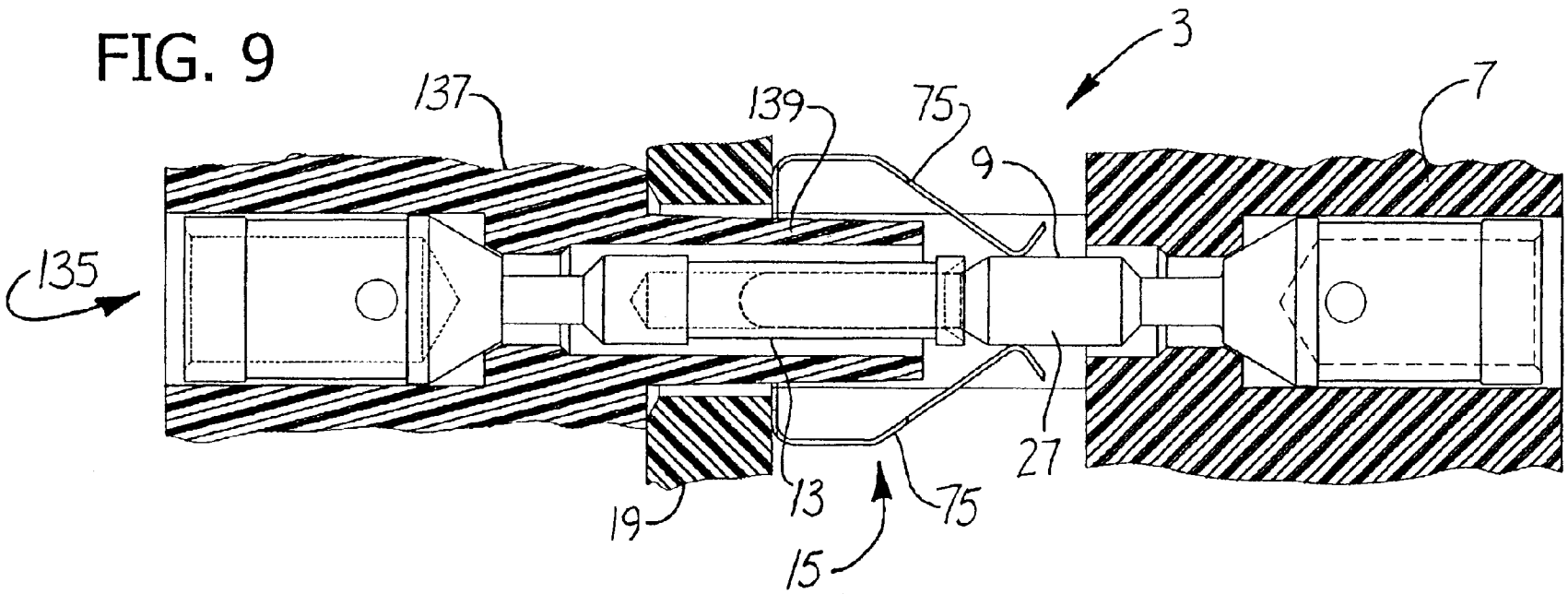
FIG. 9 is a fragmentary section of an electrical connector assembly illustrating the fully mated position of first and second connectors wherein the second connector is modified so that the shorting member remains engaged.

In certain circumstances it may be desirable to maintain a shorting connection between certain contacts 9 in the first connector 3 even when connected to another connector. FIG. 9 illustrates the first connector 3 fully connected with a modified second connector 135 including a second insulating body 137. The second insulating body 137 differs from that shown in FIGS. 1 thru 5C in that the second insulating body is modified to have at least one shortened insulating shroud 139 from which the female contact 13 protrudes. The shortened insulating shroud 139 does not contact shorting member 15 even when the first connector 3 and second connector 135 are filly mated and does not separate shorting arms 75 from the surface of the larger diameter portion 27. By selectively choosing which female contacts 13 are associated with shortened insulating shrouds 139, the shorting connection between male contacts 9 can be maintained even during full engagement of first connector 3 and second connector 135. Other shrouds (not shown) have a length sufficient to disengage the shorting member 15, when the first and second connectors 3, 135 are connected.

Figure 10:
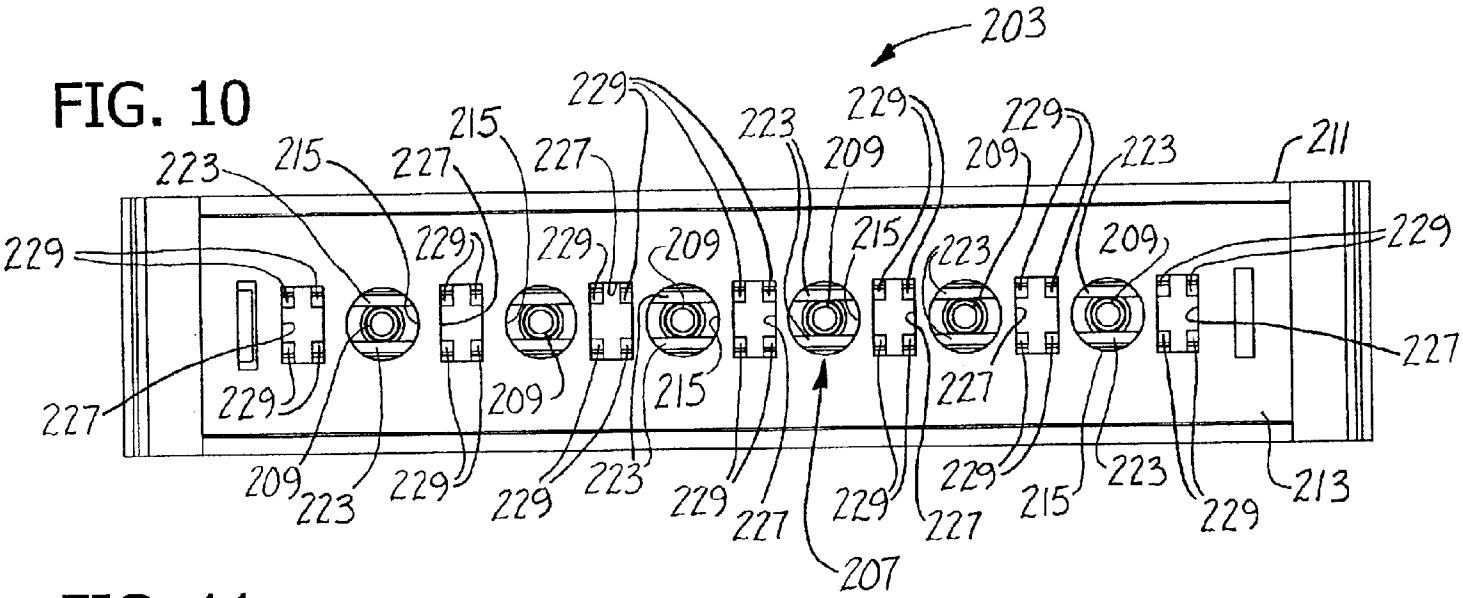
FIG. 10 is a front elevation of a first connector of the electrical connector assembly of a second embodiment.

A second embodiment of the electrical connector assembly, generally designated 201, is shown in FIGS. 10–12C to comprise a first connector 203 and a second connector 205 in which a shorting member (generally designated at 207) is associated with female contacts 209. Referring to FIGS. 10 and 12A, the first connector 203 includes a first insulating body 211 having a distinct front wall 213 in which cylindrical passageways 215 are axially aligned with female contacts 209. The female contacts 209 project from a rear portion 221 of the insulating body 211. Tubular projections 216 extend out from the rear portion 221 partially surrounding respective female contacts 209. Cylindrical passageways 215 open to an inner cavity 217 that houses the shorting member 207. Shorting member 207 is constructed similar to the shorting member 15 of FIGS. 3 and 4 in that shorting member 207 has a web 219 extending along the length of the first insulating body 211. Web 219 is fixed within inner cavity 217 against an inner surface of a rear portion 221 of the first insulating body 211 and supported by posts (not shown but similar to posts 20). Shorting member 207 has pairs of opposed arms 223 extending from the common web 219. Each pair of arms 223 is resiliently biased to contact the outer surface of aligning portion 225 of one of the female contacts 209 at opposite sides. The posts (not shown) of this embodiment are similar to posts 20 (FIG. 2) in that they are constructed to be wider than the space between adjacent pairs of opposed arms 223 when the arms are in a relaxed position so the opposing arms of each pair are in contact with and held open somewhat by one side of a corresponding post. Front wall 213 also has a series of rectangular openings 227 spaced equidistant between adjacent cylindrical passageways 215. In this embodiment, the arms 223 of the shorting member 207 are sufficiently wide that end margins 229 are in registration with the rectangular openings 227. The end margins 229 of two pairs of opposed arms 223 are aligned with each rectangular opening 227 (FIG. 10).

Figure 11:
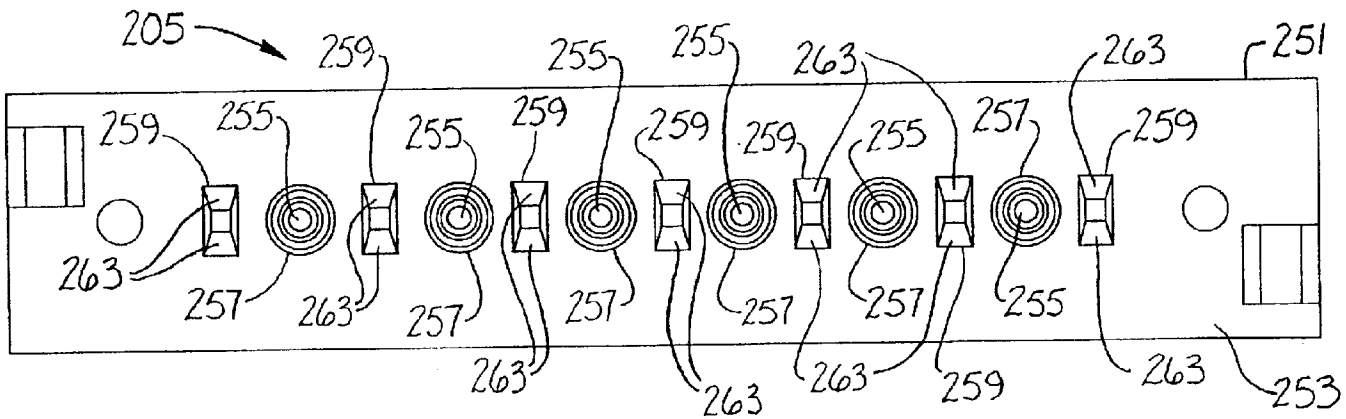
FIG. 11 is a front elevation of a second connector of an electrical connector assembly of the second embodiment.
Figure 12A:
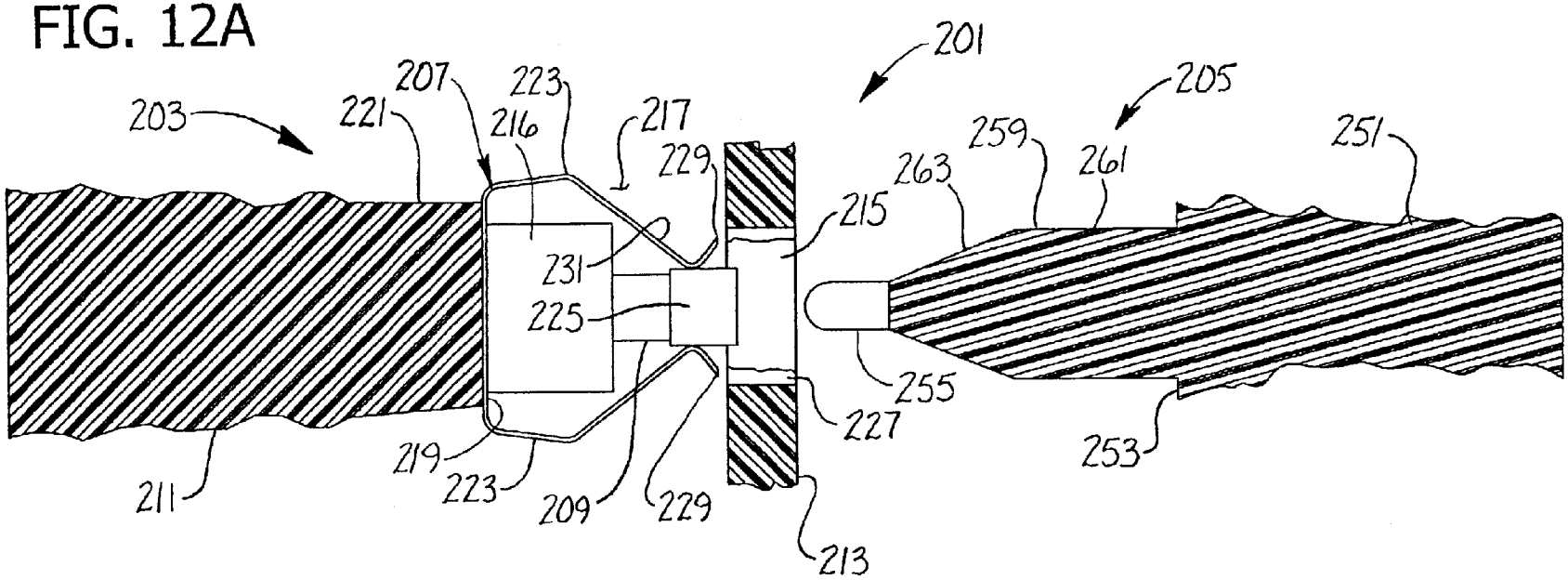
FIG. 12A is a fragmentary section of the first and second connectors of FIGS. 10 and 11 with part of a front wall of the first wall broken away to reveal a contact passageway illustrating a fully disconnected condition of the connectors.
Figure 12B:
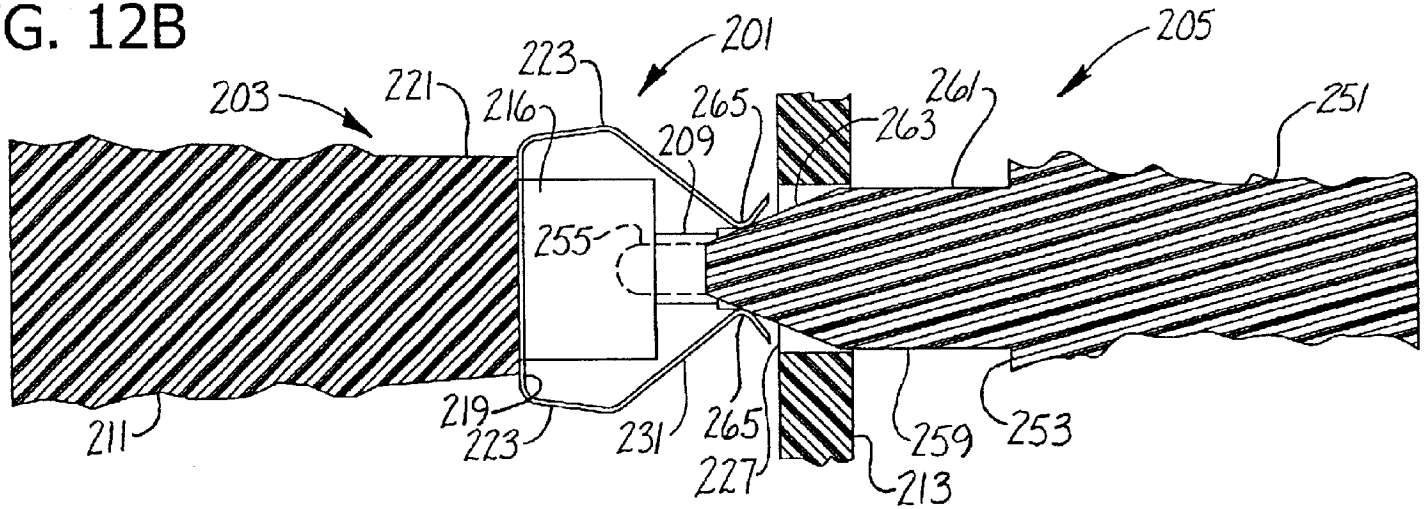
FIG. 12B is the fragmentary section of FIG. 12A, but illustrating an intermediate position prior to mating connection.
Figure 12C:
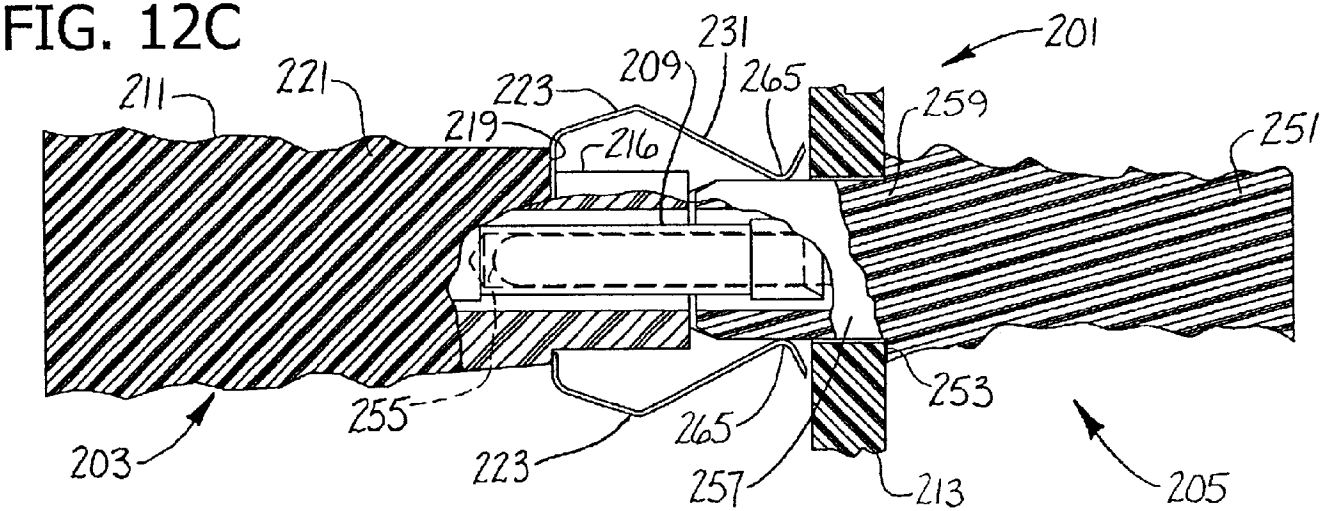
FIG. 12C is the fragmentary section of FIG. 12A, but illustrating a fully mated connection and with additional portions broken away.

Referring to FIGS. 11 and 12A, the second connector 205 includes a second insulating body 251 having a front wall 253 and male contacts 255 protruding from the front wall. A series of tubular covers 257 protrude from front wall 253 and surround a portion of male contact 255 (FIGS. 11 and 12C). The tubular covers 257 are similar to the insulating shrouds 41, but do not extend the full length of the contacts 255, so that the contacts project outwardly from the covers. A series of release wedges 259 protruding from front wall 253 are spaced equidistant between adjacent male contacts 255 and tubular covers 257. In the illustrated embodiment, the wedges 259 are integral with the second insulating body 251, both being formed out of insulating material. Tubular covers 257 are coaxial with corresponding male contacts 255 and are sized to fit through corresponding cylindrical passageways 215 of the first insulating body. Release wedges 259 have a rectangular base 261 and tapered tips 263 (having the general shape of a frustum of a pyramid) and extend from front wall 253. The release wedges 259 are sized to fit through respective rectangular openings 227 of the first insulating body 211 to wedge apart the opposed pairs of arms 223 by engagement with the end margins 229. The height of each release wedge 259 is greater than the tubular cover 257, but less than the height of the male contact 255 (see FIG. 12A).

The interengagement of first and second connectors, 203 and 205 respectively, is illustrated in a series of sectional views (FIGS. 12A–12C) similar to FIGS. 5A–5C. However, a portion of the front wall 213 is broken away to show the passageway 215 which is next to the rectangular opening 227. The description will be given for the connection of one male contact 255 with one female contact 209, the connection of the other contacts being identical. FIG. 12A shows the first connector 203 and second connector 205 as they are moved toward each other, but still in a fully disconnected position so that shorting member 207 is in electrical connection with female contact 209. Continued motion in this direction causes the end of the male contact 255 to pass through the passageway 215 and into the female contact 209, making electrical connection. It will be noted that the opposed pair of shorting arms 223 remains in contact with the female contact 209 at this time. At a roughly intermediate position of insertion illustrated in FIG. 12B, the ramped sides 263 of the tapered tip of the release wedge 259 first engages the arms 223, but has not moved them off of the female contact 209. However, the female and male contacts 209, 255 have made electrical connection in this intermediate position. As illustrated in hidden lines in that view, the male contact 255 has moved substantially into the female contact 209. As first and second connectors 203 and 205 are advanced toward the full engagement position of FIG. 12C, the shorting arms 223 are released from female contact 209 by the release wedge 259 which drives between the opposed arms and forces them apart. Engagement portions 265 of the arms travel along ramp surfaces 263 of the tapered tip and then onto the rectangular base 261. As fully connected (FIG. 12C), the shorting arms 223 contact both rectangular base 261 and/or tubular cover 257. Also, the front wall 253 of second insulating body 251 is in contact with the front wall 213 of first insulating body 211. The end of the tubular cover 257 is close to the end of the tubular protrusion 216 so that they collectively substantially enclose the interconnected male and female contacts 255, 209 to increase their effective electrical insulation. The tubular covers 257 and tubular protrusions 216, at a minimum, increase the creepage distance and clearance distance of the first and second connectors 203 and 205 by being directly interposed between the shorting arms 223 and the interconnected male and female contacts 255 and 209.

Figure 13:
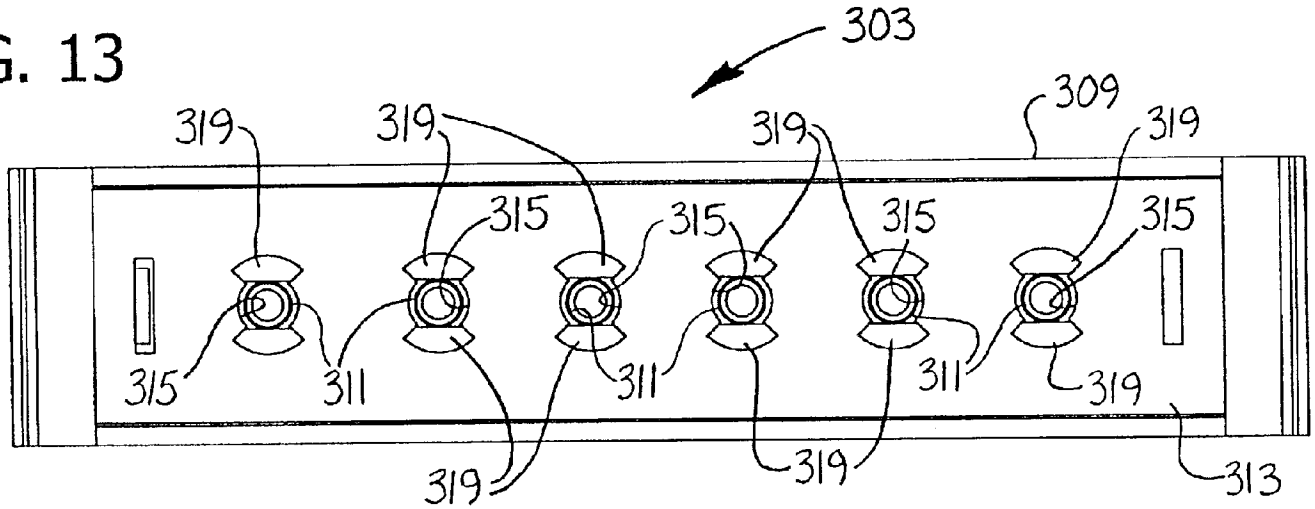
FIG. 13 is a front elevation of a first connector of the electrical connector assembly of a third embodiment.
Figure 14:
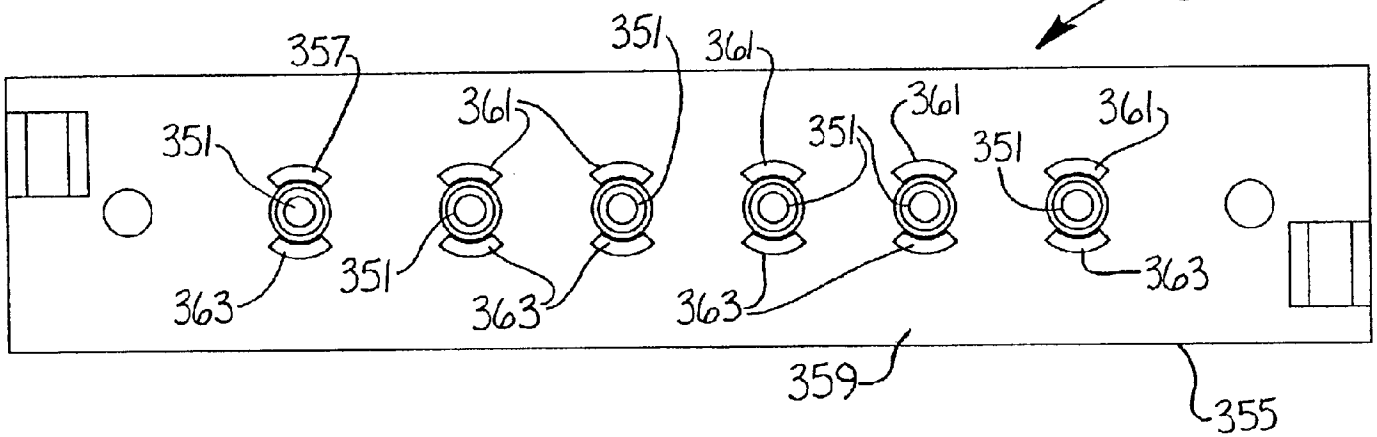
FIG. 14 is a front elevation of a second connector of an electrical connector assembly of the third embodiment.
Figure 15A:
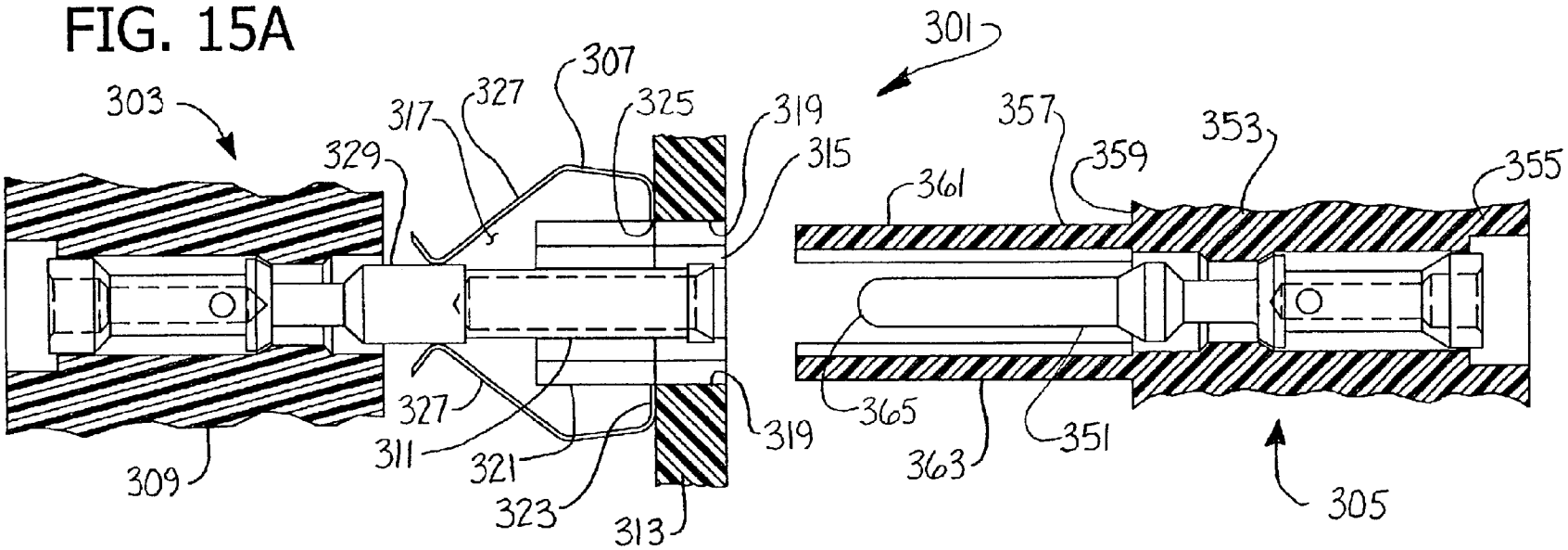
FIG. 15A is a fragmentary section of the first and second electrical connectors of FIGS. 13 and 14 illustrating a fully disconnected condition.
Figure 15B:
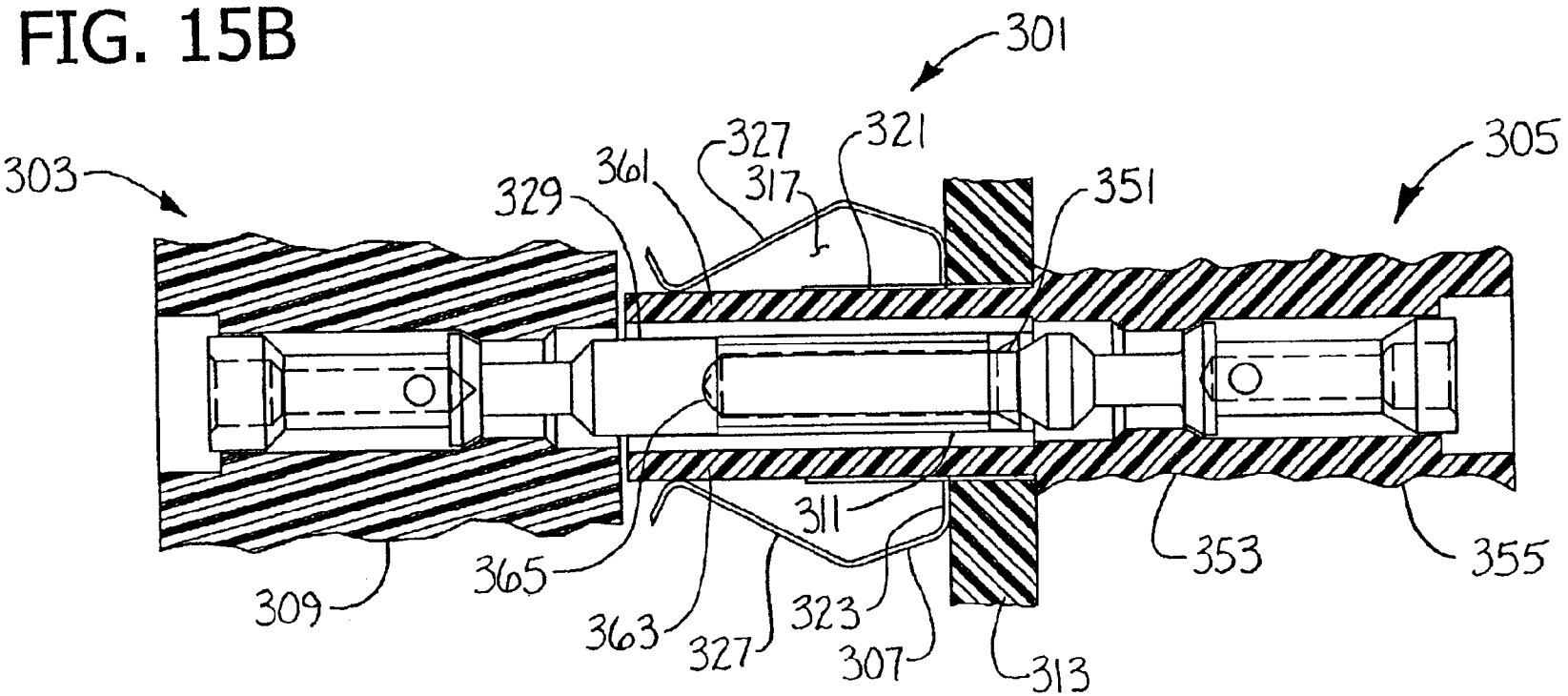
FIG. 15B is the fragmentary section of FIG. 15A but illustrating a fully mated connection.

A third embodiment of the connector assembly of the present invention, generally designated 301, is shown in FIGS. 13–15B to comprise a first connector 303 and a second connector 305 in which a shorting member 307 is housed in the first insulating body 309 having female contacts 311. The first insulating body 309 has a distinct front wall 313 with a series of passageways 315 axially aligned with female contacts 311 in inner cavity 317 that houses the shorting member 307. These passageways 315 are not cylindrical, but include arcuate extensions 319 on diametrically opposite sides of the passageways. Arcuate sleeve segments 321 extend inwardly into the inner cavity 317 from portions of the front wall 313 circumferentially adjacent to the arcuate passageway extensions 319 (FIGS. 15A and 15B). The sleeve segments 321 (only one of which is shown) are opposed to each other on opposite sides of the passageway 315. Shorting member 307 is constructed and arranged similar to the shorting member 15 of the first embodiment in that it has a web 323 held against the inner surface of front wall 313 and supported by posts (not shown but similar to posts 20). The web 323 has holes 325 axially aligned with female contacts 311 through which the arcuate sleeve segments 321 project. Opposed pairs of arms 327 extend from the common web 323 and are resiliently biased to contact the outer surface at larger diameter portions 329 of female contacts 311 (FIGS. 15A and 15B). The posts (not shown) of this embodiment are similar to posts 20 (FIG. 2) in that they are constructed to be wider than the space between adjacent pairs of opposed arms 327 when the arms are in a relaxed position so the opposing arms of each pair are in contact with and held open somewhat by one side of a corresponding post.

As shown in FIG. 14, the second connector 305 contains male contacts 351 projecting forward from a main portion 353 of a second insulating body 355. A split insulating shroud 357 is formed as one piece with and extends from front wall 359 of the second insulating body 355 substantially around the male contact 351 (FIGS. 15A and 15B). Each split insulating shroud 357 has an arcuate top and bottom prong 361 and 363 separated by axially extending breaks, instead of a continuous tubular configuration like the shroud 41 shown in FIG. 1. Top and bottom prong 361 and 363 both extend forward of male contact tip 365. Top prong 361 and bottom prong 363 both fit into corresponding upper and lower arcuate extensions 319 of openings 315 in first insulating body 309 (FIG. 13).

The connection of the first and second connectors 303 and 305 of the third embodiment is shown in FIGS. 15A and 15B. Initially (FIG. 15A), the first and second connectors 303 and 305 are fully disconnected and the shorting member 307 is in electrical connection with female contacts 311. It will be readily appreciated that, as in previous embodiments, the electrical connection between the male and female contacts, 351 and 311 respectively, is made before split insulating shroud 357 disengages shorting arms 327 from female contact. FIG. 15B illustrates the first and second connectors 303 and 305 in a fully connected position in which top prong 361 and bottom prong 363 have disengaged each respective shorting arm 327. The operation of the split shroud 357 of the third embodiment is essentially the same as the operation of the shroud 41 of the first embodiment in disengaging the opposed arms 327 from the female contacts 311. The shroud prongs 361 and 363 are disposed between the shorting arms 327 and the connected male and female contacts 351 and 311. The shroud prongs 361, 363 together with the sleeve segments 321 form a substantially continuous tubular barrier between the shorting member 307 and the interconnected contacts 311, 351 near the front wall 313. Elsewhere, the shroud prongs 361, 363 are interposed between the shorting member 307 and the contacts 311, 351.

It will be readily apparent to those of ordinary skill in the art, that upon disconnection of the first and second connectors of the three illustrated embodiments, electrical contact of the shorting member with the selected male or female contacts will occur before the male and female contacts break their electrical engagement. However, other arrangements may be used in which shorting connection is not made until after disconnection of the male and female contacts without departing from the scope of the present invention.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An electrical connector assembly comprising:

a first insulating body;

at least three first contacts, said first contacts being at least partially housed in the first insulating body;

a second insulating body;

at least three second contacts, said second contacts being at least partially housed in the second insulating body, said first and second contacts being adapted for interengagement to produce an electrical connection; and a shorting member mounted on said first insulating body and disposed for electrically connecting said at least three first contacts in an engaged position of the shorting member when the first and second contacts are not interengaged for simultaneously electrically shorting said at least three first contacts, wherein the shorting member is shaped and arranged on the first insulating body such that the second insulating body passes through the shorting member before engaging the shorting member.

2. An electrical connector assembly as set forth in claim 1 wherein said first contacts are male contacts and said second contacts are female contacts.

3. An electrical connector assembly as set forth in claim 1 wherein said first contacts are female contacts and said second contacts are male contacts.

4. An electrical connector assembly as set forth in claim 1 wherein each of said first and second contacts are machined from a solid cylindrical blank.

5. An electrical connector assembly as set forth in claim 1 wherein the shorting member is movable to a disengaged position in which at least some of said first contacts are not engaged by the shorting member when said first and second contacts are interengaged.

6. An electrical connector assembly as set forth in claim 5 wherein the shorting member comprises a web and at least one arm for each of said first contacts electrically connected to each other by the web, the arms being spaced apart from each other and resiliently movable relative to the web for engaging and disengaging said first contacts.

7. An electrical connector assembly as set forth in claim 6 wherein the web has openings therein generally axially aligned with said first contacts and disposed for receiving said second contacts therethrough when said first and second contacts are interengaged.

8. An electrical connector assembly as set forth in claim 6 wherein there is a pair of arms for each of said first contacts.

9. An electrical connector assembly as set forth in claim 6 wherein said shorting member comprises a web having a pair of arms for fewer than all of said first contacts.

10. An electrical connector assembly as set forth in claim 8 wherein the arms of each pair of arms are in generally opposed relation, each arm of the pair being connected to the web and generally converging toward the other arm toward a free end thereof.

11. An electrical connector assembly as set forth in claim 10 wherein each arm of each pair of arms has a tree end margin flaring outwardly away from the free end margin of the opposed arm of the pair to facilitate disengagement of the arms from a corresponding one of said first contacts.

12. An electrical connector assembly as set forth in claim 10 further comprising an insulating shroud surrounding each of said second contacts, the insulating shrouds being sized and shaped for engaging the arms as said first and second contacts are moved to interengage for moving the arms to the disengaged position, each shroud being interposed between said second contacts and the arms and between said second contacts and the web when said first and second contacts are interengaged.

13. An electrical connector assembly as set forth in claim 8 wherein the first insulating body has first openings therein generally aligned with the first contacts to permit access to the first contacts for electrical connection with the second contacts, and second openings generally adjacent the first openings, the second openings being at least partially aligned with the pairs of arms, and wherein the second insulating body has wedges associated therewith and disposed for passing through the second openings into engagement with respective pairs of arms for use in wedging the arms away from each other and out of electrical connection with the corresponding first contacts.

14. An electrical connector assembly comprising:

a first insulating body;

first contacts at least partially housed in the first insulating body;

a second insulating body;

second contacts at least partially housed in the second insulating body, said first and second contacts being adapted for interengagement to produce an electrical connection;

a shorting member mounted on said first insulating body and disposed for electrically connecting at least some of said first contacts in an engaged position of the shorting member when the first and second contacts are not interengaged for electrically shorting at least some of said first contacts;

an insulating shroud surrounding each of said second contacts, the insulating shrouds being sized and shaped for engaging the shorting member as said first and second insulating bodies are moved to interengage said first and second contacts for moving the shorting member to a disengaged position in which at least some of said first contacts are not electrically shorted.

15. An electrical connector assembly as set forth in claim 14 wherein the shroud is generally tubular and has an open end opposite the second insulating body to permit reception of one of said first contacts into the shroud.

16. An electrical connector assembly as set forth in claim 14 wherein the shorting member comprises a web and arms spaced apart from each other and resiliently movable relative to the web for engaging and disengaging said first contacts, the web electrically connecting the arms to each other, each shroud being interposed between said second contacts and the arms and between said second contacts and the web when said first and second contacts are interengaged.

17. An electrical connector assembly as set forth in claim 16 wherein there is a pair of arms for each of said first contacts.

18. An electrical connector assembly as set forth in claim 17 wherein the arms of each pair of arms are in generally opposed relation, each arm of the pair being connected to the web and generally converging toward the other arm toward a free end thereof, each arm of each pair of arms having a free end margin flaring outwardly away from the free end margin of the opposed arm of the pair to facilitate disengaging the arms from a corresponding one of said first contacts.

19. An electrical connector assembly as set forth in claim 16 wherein said shorting member comprises a web having arms for fewer than all of said first contacts.

20. An electrical connector assembly as set forth in claim 14 wherein the shorting member has openings therein generally axially aligned with said first contacts and disposed for receiving said second contacts therethrough when said first and second contacts are interengaged.

21. An electrical connector assembly as set forth in claim 14 wherein said first contacts are male contacts and said second contacts are female contacts.

22. An electrical connector assembly as set forth in claim 14 wherein said first contacts are female contacts and said second contacts are male contacts.

23. An electrical connector assembly as set forth in claim 14 wherein each of said first and second contacts are machined from a solid cylindrical blank.

24. An electrical connector assembly comprising:

a first insulating body formed for receiving at least three first contacts therein;

a second insulating body formed for receiving at least three second contacts therein, the second insulating body being adapted for connection with the first insulating body; and a shorting member mounted on said first insulating body and disposed for engaging said first contacts upon insertion of said first contacts into the first insulating body for electrically connecting said at least three first contacts, wherein the shorting member is shaped and arranged on the first insulating body such that the second insulating body passes through the shorting member before engaging the shorting member.

25. An electrical connector assembly as set forth in claim 24 wherein the shorting member comprises a web and at least two pairs of arms extending from the web, each pair of arms being disposed for engaging one of said first contacts on opposite sides of said one first contact.

26. An electrical connector assembly as set forth in claim 25, wherein the shorting member comprises at least three pairs of arms extending from the web.

27. An electrical connector assembly as set forth in claim 25 wherein the shorting member comprises a web having a pair of arms for fewer than all of said first contacts.

28. An electrical connector assembly as set forth in claim 24 in a kit including said first contacts uninstalled in the first insulating body.

29. An electrical connector assembly kit as set forth in claim 28 including said second contacts uninstalled in the second insulating body.

30. An electrical connector assembly as set forth in claim 25 wherein the first insulating body has first openings therein, and second openings generally adjacent the first openings, the second openings being at least partially aligned with at least two pairs of arms, and wherein the second insulating body has wedges associated therewith and disposed for passing through the second openings into engagement with respective pairs of arms for use in wedging the arms away from each other and out of electrical connection with the corresponding first contacts.

31. An electrical connector assembly as set forth in claim 24 wherein the first insulating body has a cavity and at least one holding member therein engaging the shorting member and holding the shorting member in position in the first insulating body.

32. An electrical connector assembly as set forth in claim 31 wherein the shorting member comprises a web and opposed pairs of resilient arms extending from the web, and wherein each holding member is disposed at least partially between at least one pair of arms for use in holding the arms of the pair of arms apart to facilitate insertion of one of said first contacts between the arms.

33. An electrical connector assembly comprising:

a first insulating body;

first contacts at least partially housed in the first insulating body;

a second insulating body;

second contacts at least partially housed in the second insulating body, said first and second contacts being adapted for interengagement to produce an electrical connection;

a shorting member mounted on said first insulating body and disposed for electrically connecting at least some of said first contacts in an engaged position of the shorting member when the first and second contacts are not interengaged for electrically shorting at least some of said first contacts;

an insulating shroud surrounding each of said second contacts, the insulating shrouds being sized and shaped for engaging the shorting member as said first and second insulating bodies are moved to interengage said first and second contacts for moving the shorting member to a disengaged position in which the shorting member is free from electrical contact with at least some of said first contacts, wherein the shorting member has openings therein generally axially aligned with said first contacts and disposed for receiving said second contacts therethrough when said first and second contacts are interengaged.

34. An electrical connector assembly comprising:

a first insulating body formed for receiving at least three first contacts therein;

a second insulating body formed for receiving at least three second contacts therein, the second insulating body being adapted for connection with the first insulating body; and a shorting member mounted on said first insulating body and disposed for engaging said first contacts upon insertion of said first contacts into the first insulating body for electrically connecting said at least three first contacts, wherein the shorting member comprises a web and at least two pairs of arms extending from the web, each pair of arms being disposed for engaging one of said first contacts on opposite sides of said one first contact, at least one arm of each pair of arms being disposed for engagement with the second insulating body for movement out of engagement with the first contact.

* * * * *